US006814090B2

(12) United States Patent
DeBoer et al.

(10) Patent No.: US 6,814,090 B2
(45) Date of Patent: Nov. 9, 2004

(54) IN-SINK DISHWASHER WITH A CUTTING BOARD

(75) Inventors: John M. DeBoer, St. Joseph, MI (US); Jeffery Allen Fries, Hartford, MI (US); Kenneth Todd Shelley, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 288 days.

(21) Appl. No.: 10/138,623

(22) Filed: May 3, 2002

(65) Prior Publication Data

US 2003/0205256 A1 Nov. 6, 2003

(51) Int. Cl.[7] ..... B08B 3/02
(52) U.S. Cl. ..... 134/115 R; 134/135; 134/200
(58) Field of Search ..... 134/115 R, 135, 134/182, 183, 198, 200; 4/619, 631, 638, 656

(56) References Cited

U.S. PATENT DOCUMENTS

| | | | | | |
|---|---|---|---|---|---|
| 1,995,331 | A | * | 3/1935 | Snyder et al. | 134/58 D |
| 2,929,075 | A | * | 3/1960 | Hyde | 4/629 |
| 3,207,167 | A | * | 9/1965 | Edstrom | 134/144 |
| 4,041,964 | A | | 8/1977 | Shamoon | 134/115 |
| 4,305,166 | A | | 12/1981 | Rose | 4/631 |
| 4,624,020 | A | * | 11/1986 | Abderhalden et al. | 4/651 |
| 5,016,298 | A | | 5/1991 | Ris et al. | 4/654 |
| 5,406,656 | A | | 4/1995 | Somerton | 4/656 |
| 5,560,288 | A | | 10/1996 | Licari | 99/484 |
| 5,915,851 | A | | 6/1999 | Wattrick et al. | 4/638 |

FOREIGN PATENT DOCUMENTS

| | | | |
|---|---|---|---|
| GB | 929348 | 6/1963 | |
| GB | WO90/09140 | 8/1990 | A47L/15/00 |

OTHER PUBLICATIONS

WO95/00718 Jan. 1995 (Lacombe).*
Patent Abstracts of Japan, Publication No. 2000–225027, Publication Date Aug. 15, 2000.

* cited by examiner

*Primary Examiner*—Frankie L. Stinson
(74) *Attorney, Agent, or Firm*—John F. Colligan; Robert O. Rice; Stephen Krefman

(57) ABSTRACT

A dish-cleaning appliance comprising a sink having a bowl with an open top for providing access to the bowl. A rack for holding dishes is provided and is received within the bowl and a liquid recirculation system is provided for spraying liquid onto the dish rack to effect the cleaning of any dishes along the rack. The lid is mounted to the sink and is movable to selectively cover the open top of the bowl. A cutting board is positioned on top of the lid and a releasable coupling secures the cutting board to the lid to limit relative movement of the cutting board and the lid.

17 Claims, 8 Drawing Sheets

IN-SINK DISHWASHER WITH A CUTTING BOARD

BACKGROUND OF THE INVENTION

1. Field of the Invention

The invention relates to an in-sink dishwasher for automatically washing household dishes without requiring the physical space of a built-in automatic dishwasher. The invention further relates to an in-sink dishwasher in combination with a cutting board adapted for mounting to a lid of the in-sink dishwasher to prevent the relative movement between the cutting board and the in-sink dishwasher.

2. Description of the Related Art

In-sink dishwashers use the bowl of a sink to form part of the dishwasher housing that defines a portion of the wash chamber, with the open top of the bowl providing access to the bowl. A liquid recirculation system effects the spraying of a wash liquid throughout the bowl to clean any dishes placed within the wash chamber. A lid covers the open top of the bowl when the in-sink dishwasher is being used to prevent the splashing or spraying of the recirculating wash liquid out of the open top of the bowl.

It is anticipated that users of in-sink dishwashers will use the lid as an extension of the countertop surrounding the sink when the lid is in the closed position. It is further anticipated that the user will place objects on the lid as part of the normal meal preparation process. One such anticipated object is a cutting board for use in cutting food items as part of meal preparation.

For accuracy in cutting and to reduce spillage of items on the cutting board, it is desirable to limit the relative movement between the cutting board and the lid.

SUMMARY OF THE INVENTION

The invention relates to a dish-cleaning appliance comprising a sink having a bowl with an open top for providing access to the bowl. A rack for holding dishes and the like is received within the bowl. A liquid recirculation system sprays liquid onto the dish rack to effect the cleaning of any dishes on the rack. The lid is mounted to the sink and is movable to selectively cover the open top of the bowl. A cutting board is positioned on top of the lid and a releasable coupling secures the cutting board to the lid to substantially prevent the relative movement between the cutting board and the lid.

The releasable coupling may comprises a first interactive element on the lid and a second interactive element on the cutting board. The first and second interactive elements interact to substantially prevent the movement of the cutting board relative to the lid. The first interactive element can be one of a projection and a recess and the second interactive element can be the other of the projection and the recess. The projection is sized to be received within the recess to substantially prevent the movement of the cutting board relative to the lid.

In one embodiment, the projection extends from a lower surface of the cutting board and the recess is formed in an upper surface of the lid. The projection can comprise multiple projections. Correspondingly, the recess can comprise multiple recesses. The recess preferably lies entirely within the perimeter of the lid. The first interacting element can also comprise a recess formed in an upper surface of the lid and the second interacting element can comprise multiple spaced feet extending from a lower surface of the cutting board and received within the recess. The recess comprises a peripheral side wall and the feet are located on the cutting board such that the feet abut the peripheral side wall when the feet are received within the recess. The recess peripheral side wall is beveled and at least one of the feet has an angled side wall that complements the bevel of the peripheral side wall. The feet preferably have a height such that the feet touch a lower surface of the recess when the feet are received within the recess. The feet height is also such that the lower surface of the cutting board lies above the lid. The sink can comprise a second bowl that is spaced from the first bowl. The cutting board can be sized such that a portion of the cutting board spans the area separating the first and second bowls. The portion of the cutting board spanning the first and second bowls may have an edge that is substantially coplanar with a portion of a side wall of the second bowl adjacent the first bowl.

The cutting board can be made from a variety of materials, such as wood, plastic, and stone.

DESCRIPTION OF THE PREFERRED EMBODIMENT

Figure 1:
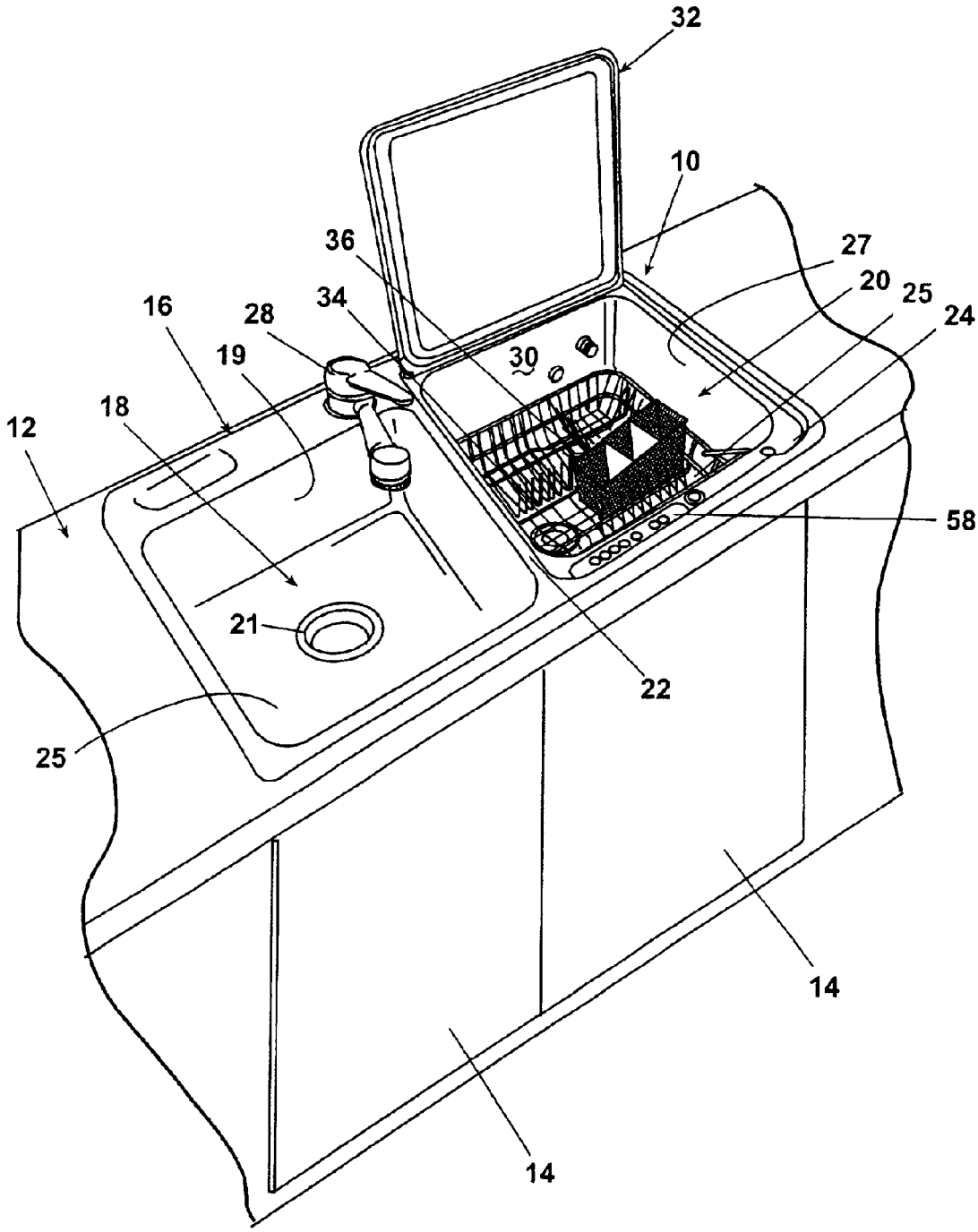
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl.

FIG. 1 illustrates an in-sink dishwasher 10 mounted in a traditional cabinet fixture 12 having doors 14 providing access to the cabinet interior where the lower portion of the in-sink dishwasher 10 is located.

The in sink dishwasher 10 is illustrated in the environment of a double-bowl sink 16 comprising a first bowl 18 and a second bowl 20, with each bowl having a bottom wall 25 and a peripheral side wall 19, 27, respectively. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel.

A traditional water faucet 28 is located in the peripheral flange 24 of the double-bowl sink and provides water to either of the first and second bowls 18, 20.

Figure 2:
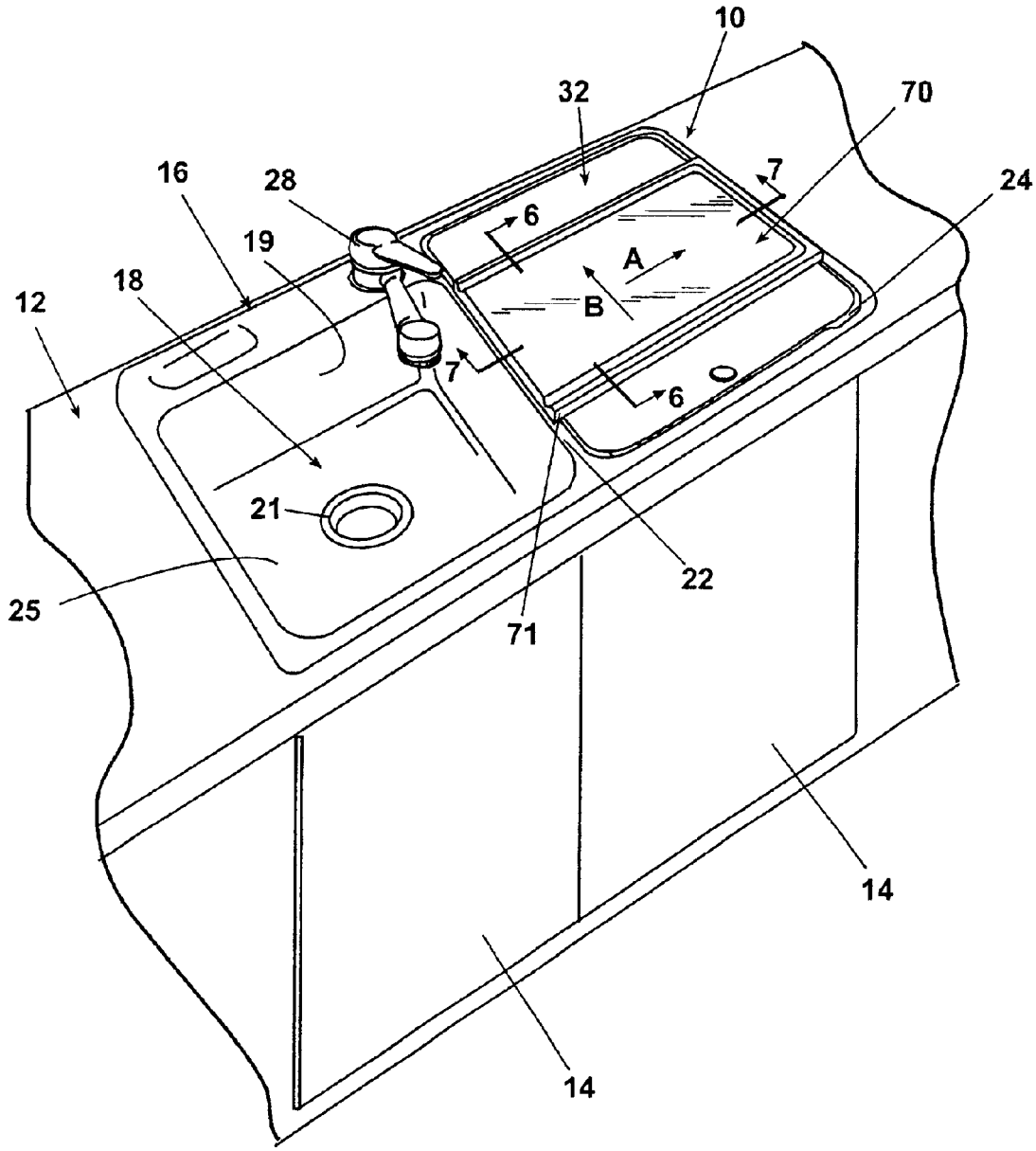
FIG. 2 is a perspective view substantially identical to FIG. 1 except that the lid is shown in the closed position and a cutting board is shown positioned on the lid upper surface.

Referring to FIGS. 1 and 2, the in-sink dishwasher 10 comprises a wash chamber 30 that is defined by the second bowl 18, which has an open top. A lid 32 is hingedly mounted to the peripheral flange 24 of the double-bowl sink 16 and is movable between an opened position as shown in FIG. 1 and a closed position as shown in FIG. 2.

A drain 34 along with a water inlet 36 are provided in the bottom of the second bowl 20 and provide for the draining and introduction of water from and into the wash chamber 30. The drain 34 serves as a drain during the use of the bowl 20 as a traditional sink and when used as a wash chamber 30 for the in-sink dishwasher 10.

Figure 3:
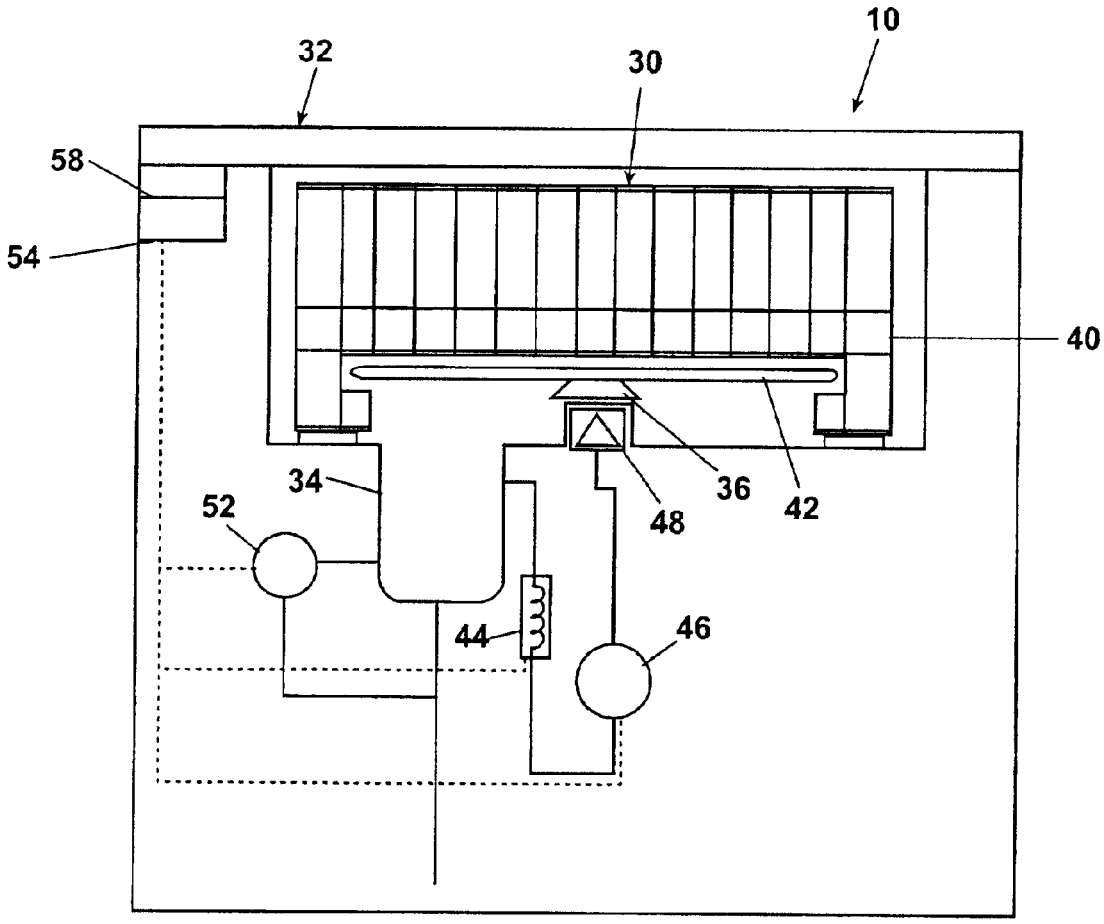
FIG. 3 is a schematic illustration of the major components of the in-sink dishwasher.

FIG. 3 schematically illustrates the major components of the in-sink dishwasher 10, which include a rack 40 comprised of multiple wire segments for holding various dishes and utensils. The exact shape and configuration of the rack 40 is not germane to the invention and is preferably made similar to those found in automatic dishwashers.

A spray arm 42 is preferably mounted to the bottom of the rack 40 such that the spray arm is free to rotate relative to the rack 40 and is removed from the wash chamber when the rack is removed. The spray arm 42 couples with the water inlet 36 when the rack 40 is positioned within the second bowl 20.

The drain 34 has one outlet that is fluidly coupled to an in-line water heater 44. The output of the water heater 44 is received as input to a recirculation pump 46, whose output is sent to a valve 48 forming part of the water inlet 36.

The drain 34, water inlet 36, in-line water heater 44, recirculation pump 46, valve 48, and spray arm 42 collectively form a recirculation system for recirculating wash liquid throughout the wash chamber 30.

The drain 34 has another outlet that is fluidly connected to a drain pump 52. The output of the drain pump 52 is fluidly connected to the traditional drain line for the second bowl 20. The drain pump 52 provides for a positive draining of liquid from the wash chamber 30, such as, for example, when it is no longer desire to recirculate the wash liquid with the recirculation system.

A controller 54, preferably a microprocessor-based controller, is electronically coupled to the in-line heater 44, recirculation pump 46, and drain pump 52 to control their respective operation. If the valve 48 is an actuated valve, such as a solenoid-actuated valve, instead of a check valve, then the controller 54 can also be connected to the valve 48 and control its operation.

The controller 54 operates the in-line heater 44, recirculation pump 46, and drain pump 52 to implement a wash cycle. Preferably, the wash cycle is one of many well-known wash cycles stored in the memory of the microprocessor.

A user interface 58 is located adjacent the second bowl 20 and is electronically coupled to the controller 54. The user interface 58 permits the user to select the desired wash cycle from the multiple wash cycles stored in the memory of the microprocessor and enter any necessary or optional operating data or parameters for the wash cycles.

Figure 4:
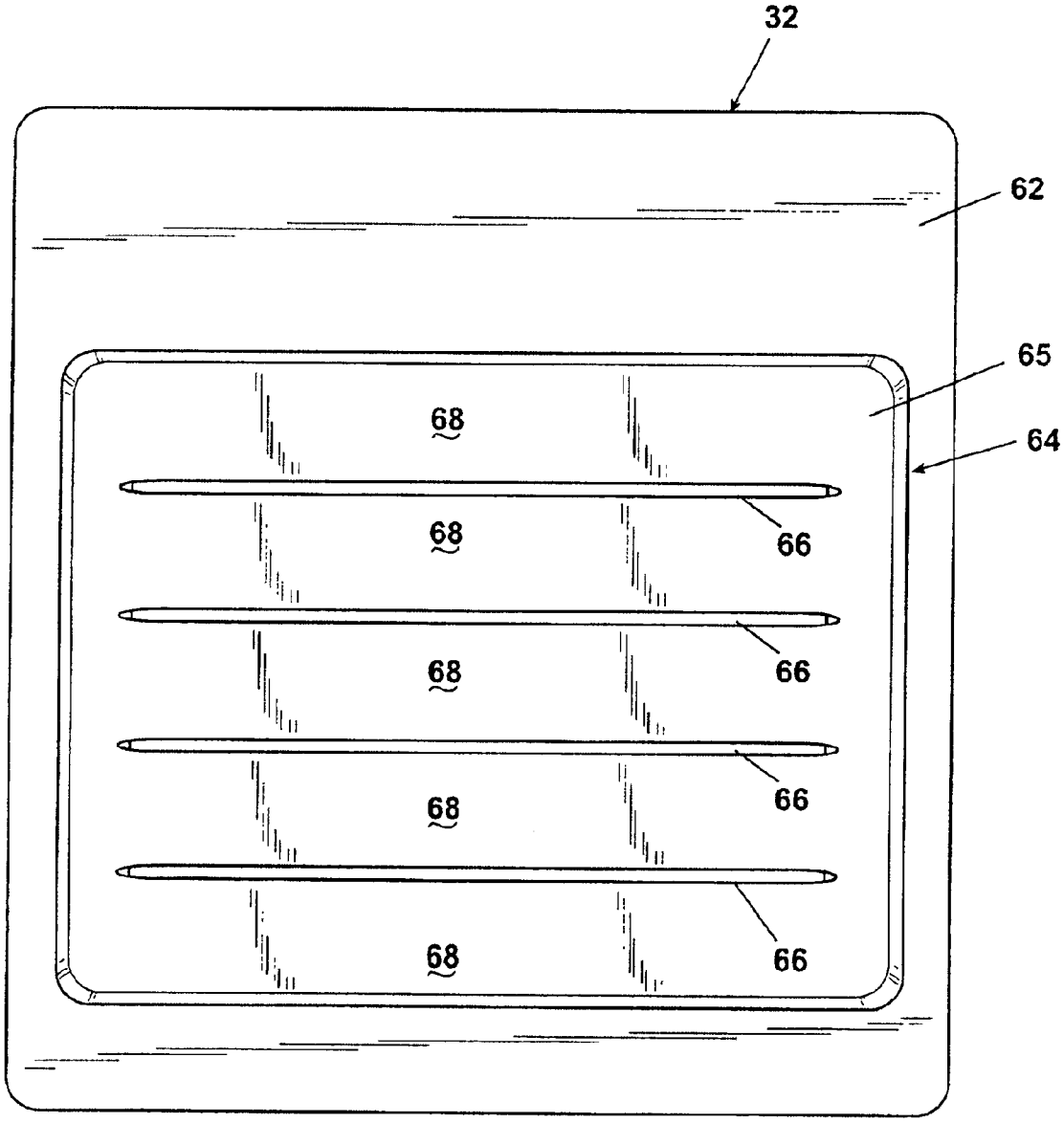
FIG. 4 is a top view of the lid of FIG. 1 and illustrating the upper surface of the lid.

Referring to FIG. 4, the top of the lid is shown in greater detail and comprises an upper surface 62 having a generally planar contour and in which is formed a recess 64. The recess has an outer periphery 65 that is substantially rectangular and extends laterally across the upper surface 62. Preferably, the recess does not extend all the way to the peripheral edge of the lid.

A series of longitudinally extending projections or ribs 66 are located in the recess 64 and effectively divide the recess 64 into multiple or sub-recesses 68. The ribs 66 are preferably of a height such that they do not extend beyond the plane defined by the upper surface 62.

Figure 5:
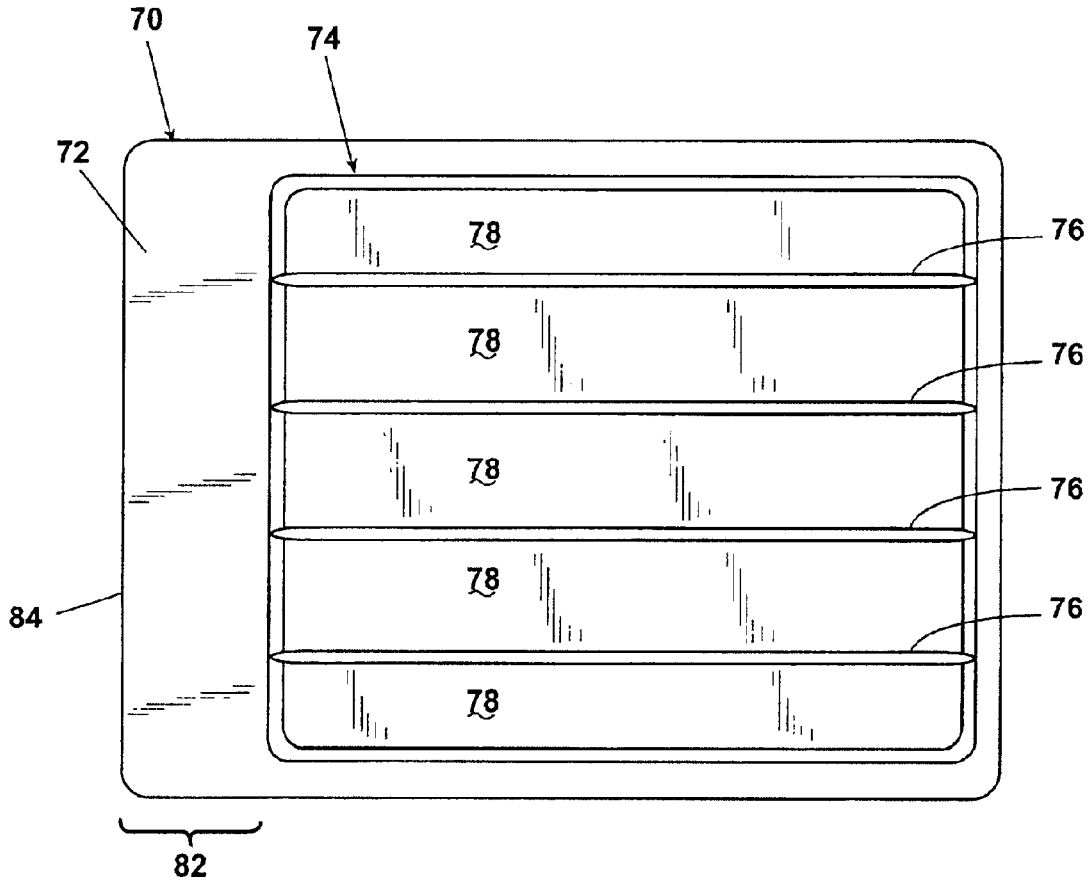
FIG. 5 is a bottom view of the cutting board of FIG. 1 and illustrating the lower surface of the cutting board.

Referring to FIGS. 2 and 5, a cutting board 70 can be positioned on the lid 32 when the lid is in the closed position. The cutting board is preferably sized such that at least a portion 71 of the cutting board spans the space between the first and second bowls. Preferably the distal edge of the cutting board terminates at the first bowl and does not substantially overlie the first bowl.

The cutting board is preferably made from wood. However, the material of the cutting board is not germane to the invention. Other suitable materials such as plastic and stone can also be used for the cutting board.

Referring to FIG. 5, the cutting board 70 comprises a lower surface 72 having a generally planar contour and from which extends a projection 74 whose outer periphery 75 is complementary to the outer periphery 65 of the lid recess 64. Multiple longitudinal grooves 76 are formed in the projection 74 to effectively sub-divide the projection 74 into multiple projections or sub-projections 78.

Preferably, the grooves 76 are located in the projection 74 such that they correspond to the same relative location as the ribs 66 in the recess 64, resulting in each of the sub-projections 78 having a generally longitudinal shape that corresponds and is complementary to one of the sub-recesses 68.

The cutting board further includes a portion 82 that overlies the flange 22 separating the bowls 18, 20 when the cutting board is mounted to the lid. The portion 82 preferably terminates in an edge 84 that aligns with the peripheral side wall 19 when the cutting board is mounted to the lid. While it is within the scope of the invention for the cutting board to be of a length such that the edge 84 of the portion 82 is suspended over the bowl 18, it is preferred that the edge 84 terminates at the plane of the side wall to maximize the usable area of the bowl 18.

Figure 6:
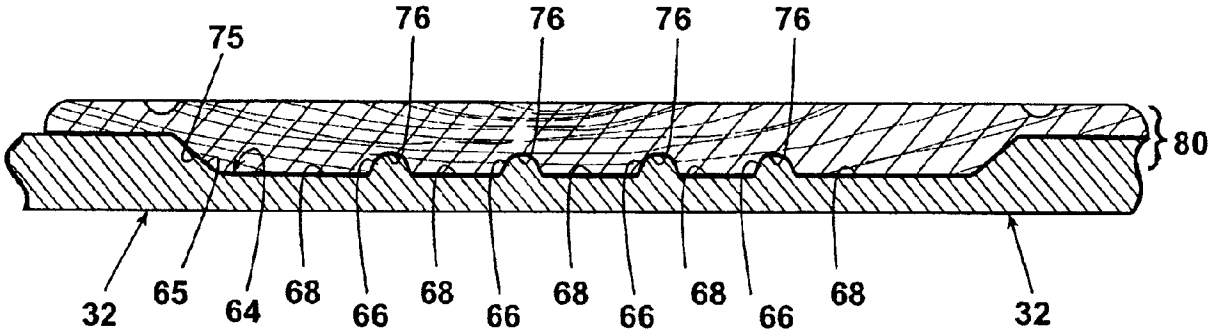
FIG. 6 is a sectional view taken along line 6—6 of FIG. 2 and illustrating the releasable coupling securing the cutting board to the lid along a transverse direction.
Figure 7:
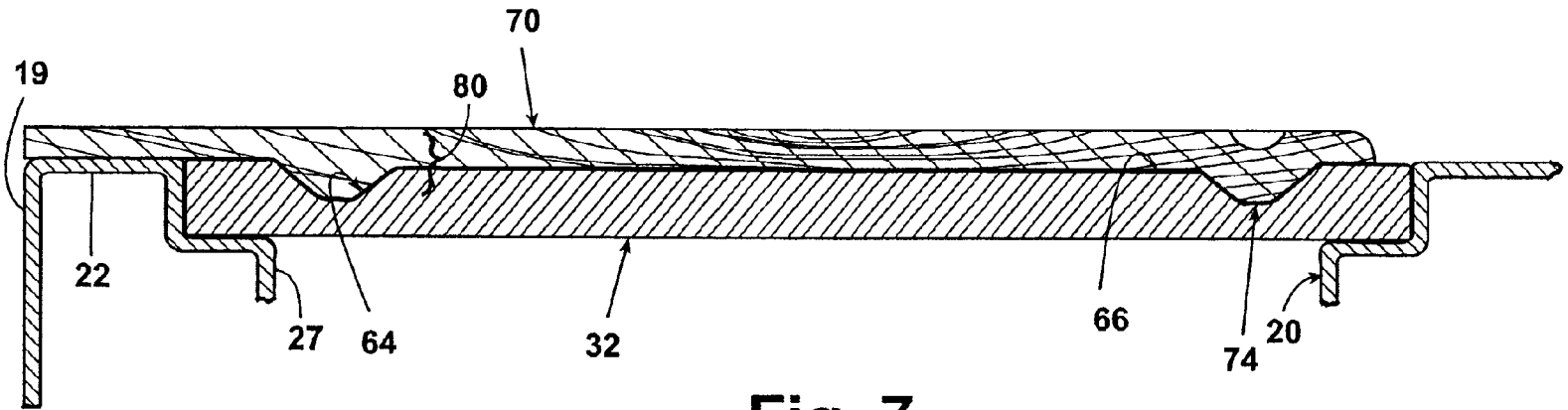
FIG. 7 is a sectional view taken along line 7—7 of FIG. 2 and illustrating the releasable coupling securing the cutting board to the lid along a longitudinal direction.

Referring to FIGS. 6 and 7, the projection 74 of the cutting board and the recess 64 of the lid collectively form a releasable coupling 80 that secures the cutting board 70 to the lid 32 to limit the relative movement between the cutting board 70 and lid 32. The nesting or mating of the projection 74 within the recess 64 results in the corresponding peripheral edges 65, 75, respectively, interacting to limit the movement of the cutting board relative to the lid in two dimensions defined by the arrows A and B in FIG. 2. Arrow B corresponds to the most common direction that a user of the cutting board will apply a force to the cutting board. The receipt of the ribs 66 within the grooves also interact to provide an additional structure that limits the relative movement of the cutting board in the direction of the arrow B.

To mount the cutting board 70 to the lid 32, the cutting board is oriented such that the lower surface 72 of the cutting board 70 faces towards upper surface 62 of the lid 32 and aligns the cutting board 70 such that the projection 74 extending from the lower surface of the cutting board 70 is received within the recess 64 on the upper surface 62 of the lid 32.

Since the grooves 76 and the projection 74 of the cutting board 70 are spaced such that they correspond to the ribs 66 within the recess 64 of the lid 32, the ribs 66 will be received within the grooves 76 when the cutting board is nested or mated with the lid. The complementary grooves 76 and ribs 66 will also locate and align the cutting board 70 relative to the lid 32.

It is preferred, but not necessary, that the grooves 76 extend all the way across the projection 74 in contrast to the ribs 66 that do not extend all way across the recess 64. The extra length associated with the grooves 76 will aid the user in laterally aligning the projection 74 of the cutting board with respect to the recess 64 and the lid 32.

As is seen in FIGS. 6 and 7, when the cutting board 70 is nested or mated with the recess 64 of the lid 32, the ribs 66 of the lid 32 are received within the grooves 76 such that the apex of the ribs 66 are closely adjacent to or touch the bottom of the corresponding grooves 76. Also, the peripheral edge of the projection 74 is closely adjacent to or in abutting relationship with the peripheral edge of the recess 64.

The close relationship or abutting contact between peripheral edges 65, 75 of the projection and recess along and in combination with the close relationship or abutting contact between the ribs and the corresponding grooves defined a releasable coupling that limits the relative movement of the cutting board in the plane of the upper surface of the lid. While it is preferred to use both the peripheral edges of the projection and recess and the complementary ribs and grooves to form the releasable coupling, it is not necessary to use both.

While it is preferred that there be little gap between the peripheral edges 65, 75 when the projection 74 is inserted with the recess 64 to thereby minimize the amount of "play" or limited relative movement between the cutting board 70 and the lid 32, it is not necessary to prevent all relative movement.

Other types of releasable coupling can also be used to limit the relative movement of the cutting board and the lid. For example, the cutting board could be provided with a series of point-like discrete projections, such as a stud, in combination with a corresponding opening, instead of the ribs and grooves.

Figure 8:
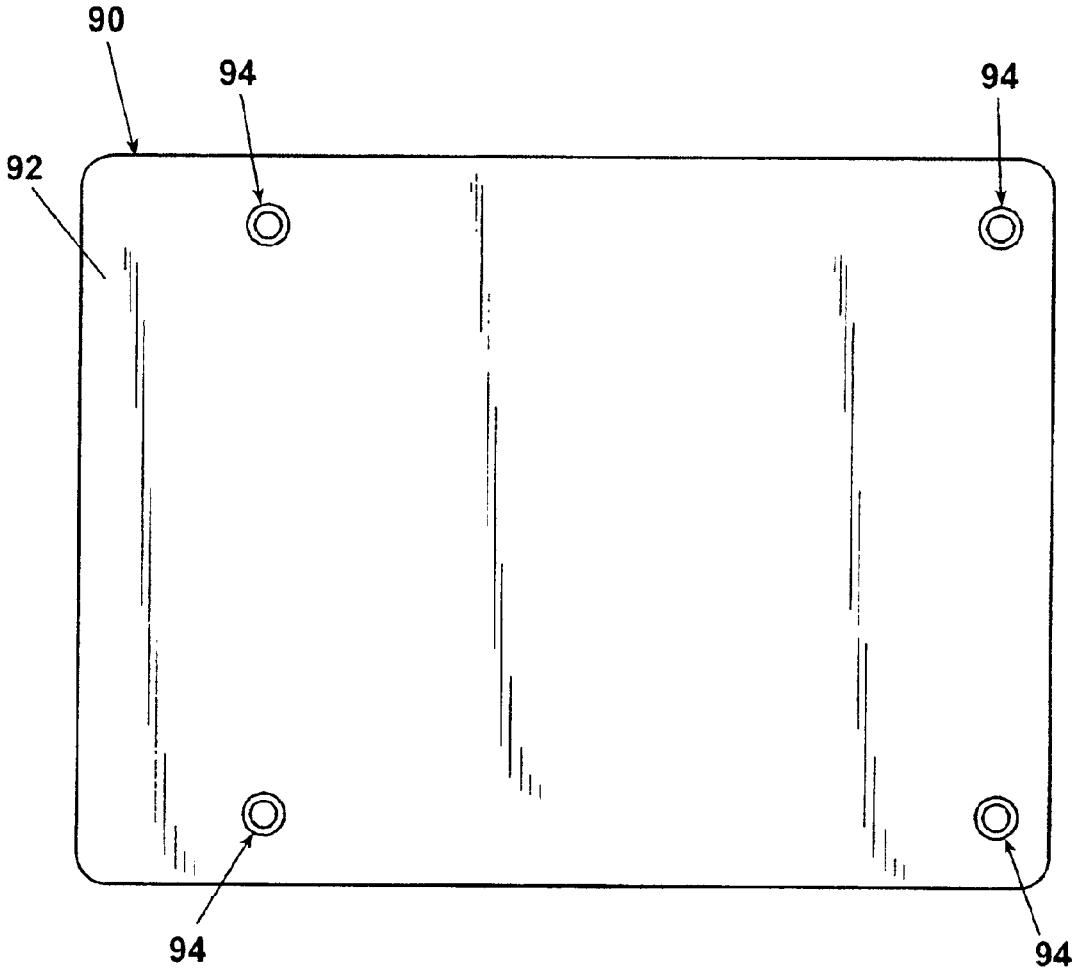
FIG. 8 is a bottom view of a cutting board with a second embodiment releasable coupling.
Figure 9:
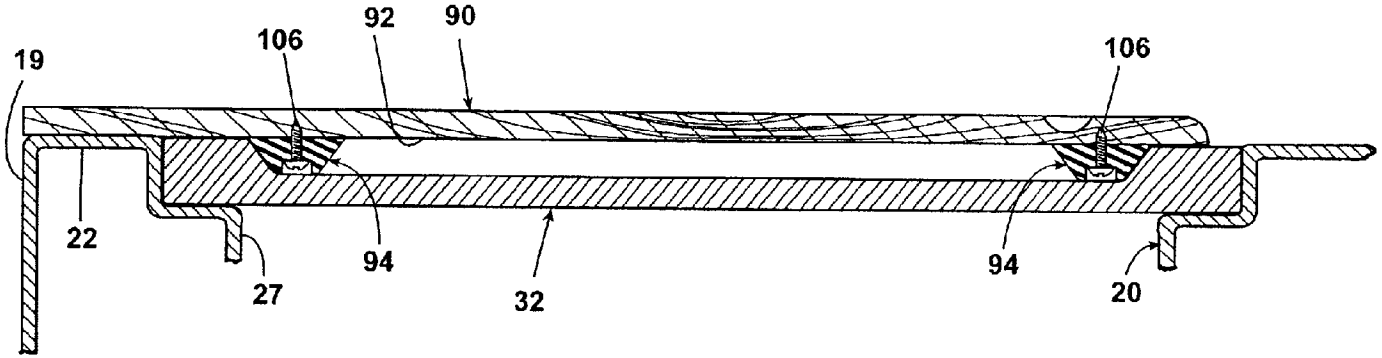
FIG. 9 is a sectional view similar to FIG. 7 and illustrating the second embodiment releasable coupling.
Figure 10:
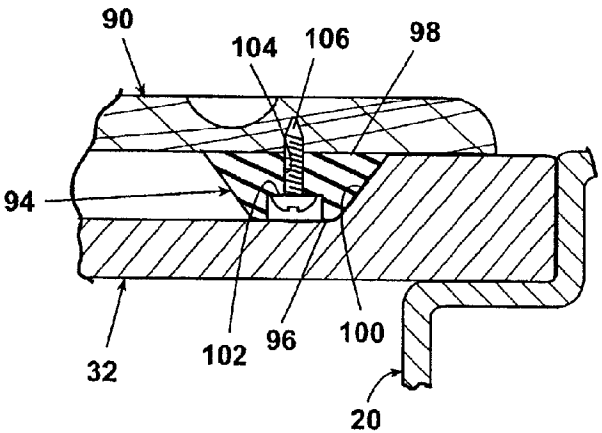
FIG. 10 is an enlarged sectional view of a foot forming part of the second embodiment releasable coupling.

FIGS. 8–10 illustrate a second embodiment of a cutting board connected to the lid by a releasable coupling according to the invention. The second embodiment comprises a cutting board 90 having a planar lower surface 92, which does not include a projection like the first embodiment. Instead, multiple feet 94 are located on the lower surface 92 of the cutting board 90. Preferably, there are four feet, with each foot being located corresponding to a corner of the recess 64, although more or less feet can be used.

The feet 94 are can made from rubber and have a frusto-conical shape with a lower end 96 and upper end 98, which are connected by a tapered peripheral side wall 100. The angle of the taper is preferably complementary to the angle of the bevel 65 of the recess 64 so that the peripheral side wall 100 contacts the bevel 65 for most of its length.

The lower end 96 is countersunk to define a shoulder 102 and an fastener opening 104. A fastener, such as screw 106, mounts the foot to the cutting board. The head of the screw 106 abuts the shoulder 102 and the threaded end of the screw extends through the fastener opening 104 and is threaded into the cutting board through the lower surface 92.

When the cutting board 90 with the feet 94 is coupled to the lid 32, the feet 94 are located at each corner of the recess 64. The peripheral side wall 100 of each foot preferably contacts the corresponding portion of the bevel 65. The multi-point contact with the bevel 65 prevents the cutting board from being moved laterally. The feet 94 and the corresponding portion of the bevel 65 of the recess 64 form a releasable coupling.

The feet preferably have height such that the lower surface 92 of the cutting board 92 just makes contact with, or is slightly above, the upper surface of the lid 32 and the lower end 96 of the feet contact the bottom of the recess 64. The contact of the bottom of the recess 64 by the feet provides another interference coupling, in the form of a frictional interference, between the feet 94 and the lid 32 to retard the lateral movement of the cutting board and lid.

While the invention has been specifically described in connection with certain specific embodiments thereof, it is to be understood that this is by way of illustration and not of limitation, and the scope of the appended claims should be construed as broadly as the prior art will permit. For example, although the preferred sink configuration is a double-bowl sink, the in-sink dishwasher can also be used in a single-bowl sink.

What is claimed is:

1. A dish-cleaning appliance comprising:

a sink having a bowl with an open top for providing access to the bowl;

a rack for holding multiple dishes and sized to be received within the bowl;

a liquid recirculation system for spraying liquid onto the dish rack;

a lid mounted to the sink and moveable to selectively cover the open top of the bowl;

a cutting board positioned on the lid; and a releasable coupling securing the cutting board to the lid to limit the relative movement of the cutting board and the lid.

2. The dish-cleaning appliance according to claim 1, wherein the releasable coupling comprises a first interacting element on the lid and a second interacting element on the cutting board wherein the first and second interacting elements interact to substantially prevent the movement of the cutting board relative to the lid.

3. The dish-cleaning appliance according to claim 2, wherein the first interacting element is one of a projection and recess and the second interacting element is the other of the projection and recess, and the projection is sized to be received within the recess to substantially prevent the movement of the cutting board relative to the lid.

4. The dish-cleaning appliance according to claim 3, wherein the projection extends from a lower surface of the cutting board and the recess is formed in an upper surface of the lid and when the projection is received within the recess the lateral movement of the cutting board relative to the lid is substantially prevented.

5. The dish-cleaning appliance according to claim 4, wherein the projection comprises multiple projections and the recess comprises multiple recesses corresponding to the multiple projections.

6. The dish-cleaning appliance according to claim 4, wherein the recess lies entirely within the perimeter of the lid.

7. The dish-cleaning appliance according to claim 4, wherein the sink comprises a second bowl spaced from the first bowl and the cutting board is sized such that a portion of the cutting board spans the space between the first and second bowls.

8. The dish-cleaning appliance according to claim 7, wherein the portion of the cutting board spanning the first and second bowls terminates in an edge, the second bowl is partially defined by a peripheral side wall, and the edge is substantially coplanar with a portion of the peripheral side wall adjacent the second bowl.

9. The dish-cleaning appliance according to claim 8, wherein the cutting board is made from one of wood, plastic, and stone.

10. The dish-cleaning appliance according to claim 2, wherein the first interacting element comprises a recess formed in an upper surface of the lid and the second interacting element comprises multiple spaced feet extending from a lower surface of the cutting board and received within the recess.

11. The dish-cleaning appliance according to claim 10, wherein the recess comprises a peripheral side wall and the feet are located on the cutting board such that the feet abut the peripheral side wall when the feet are received within the recess.

12. The dish-cleaning appliance according to claim 11, wherein the recess peripheral side wall is beveled and at least one of the feet has an angled side wall that complements the bevel of the peripheral side wall.

13. The dish-cleaning appliance according to claim 11, wherein the feet have a height such that the feet touch a lower surface of the recess when the feet are received within the recess.

14. The dish-cleaning appliance according to claim 13, wherein the feet have a height such that the lower surface of the cutting board lies above the lid.

15. The dish-cleaning appliance according to claim 1, wherein the sink comprises a second bowl spaced from the first bowl and the cutting board is sized such that a portion of the cutting board spans the space between the first and second bowls.

16. The dish-cleaning appliance according to claim 15 wherein the portion of the cutting board spanning the first and second bowls terminates in an edge, the second bowl is partially defined by a peripheral side wall, and the edge is substantially coplanar with a portion of the peripheral side wall adjacent the second bowl.

17. The dish-cleaning appliance according to claim 16, wherein the cutting board is made from one of wood, plastic, and stone.

* * * * *